US010286660B2

(12) United States Patent
Sakurai

(10) Patent No.: US 10,286,660 B2
(45) Date of Patent: May 14, 2019

(54) LIQUID DISCHARGE HEAD AND LIQUID DISCHARGE APPARATUS

(71) Applicant: CANON KABUSHIKI KAISHA, Tokyo (JP)

(72) Inventor: Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 15/372,245

(22) Filed: Dec. 7, 2016

(65) Prior Publication Data

US 2017/0182771 A1 Jun. 29, 2017

(30) Foreign Application Priority Data

Dec. 25, 2015 (JP) ..... 2015-254285

(51) Int. Cl.
*B41J 2/14* (2006.01)

(52) U.S. Cl.
CPC ..... *B41J 2/14088* (2013.01); *B41J 2/14072* (2013.01); *B41J 2002/14491* (2013.01)

(58) Field of Classification Search
CPC ..... B41J 2/14088; B41J 2/14072; B41J 2002/14491
See application file for complete search history.

(56) References Cited

U.S. PATENT DOCUMENTS 8,517,513 B2 * 8/2013 Fang ..... B41J 2/14072 347/40
2008/0273053 A1 * 11/2008 Takeuchi ..... B41J 2/14072 347/22
2011/0210997 A1 * 9/2011 Tamaru ..... B41J 2/14129 347/9

FOREIGN PATENT DOCUMENTS

JP 4995355 B2 8/2012

* cited by examiner

*Primary Examiner* — Yaovi M Ameh
(74) *Attorney, Agent, or Firm* — Canon U.S.A., Inc. IP Division

(57) ABSTRACT

A liquid discharge head which discharges a liquid, includes, a substrate on which plural heaters configured to generate heat for discharging a liquid are provided, an electroconductive protective film configured to cover the plural heaters and define a group consisting of the covered plural heaters in the substrate, a discrete wiring connected with the protective film for each group in the substrate, a common wiring connected with the discrete wiring for each group in common, and a terminal connected with the common wiring and configured to electrically connect the common wiring with an outside of the substrate, wherein electrical resistance of the discrete wiring is higher than electrical resistance of the common wiring.

16 Claims, 8 Drawing Sheets

LIQUID DISCHARGE HEAD AND LIQUID DISCHARGE APPARATUS

BACKGROUND OF THE INVENTION

Field of the Invention

Embodiments of the present invention generally relate to a liquid discharge head and a liquid discharge apparatus, and more particularly, relate to a liquid discharge head in which an electroconductive protective film provided on a heater which generates heat upon application of a voltage for discharge of a liquid, such as ink, is provided in common to plural heaters.

Description of the Related Art

In an electroconductive protective film formed on plural heaters arranged on a substrate which constitute a liquid discharge head, a common pattern of an electroconductive protective film corresponding to plural heaters is often used. An electrical leakage check between an electroconductive protective film and a heater wiring layer is performed, for example, as an examination after the manufacture of a substrate. The electrical leakage check is performed for the following reason. If an electrical leakage occurs between the electroconductive protective film and a heater wiring layer, oxidization and dissolution of the electroconductive protective film caused by an electrochemical reaction between the electroconductive protective film and the ink due to an influence of a potential for driving the heater drive potential may proceed, and a change in discharge characteristics and defective discharge may be caused. By using a common pattern of the electroconductive protective film, the electrical leakage check on plural heaters can be performed collectively, and therefore the examination can be simplified.

As a form of using a common pattern of an electroconductive protective film, Japanese Patent No. 4995355 describes a configuration of removing kogation adhering on the electroconductive protective film upon discharge of ink by applying an appropriate potential for the electroconductive protective film on the heater and controlling an electrochemical reaction between the electroconductive protective film and the ink. Also in this case, the electrical potential of the electroconductive protective film on plural heaters can be collectively controlled as an electrically common pattern.

In the configuration in which the electroconductive protective film is used in common to the plural heaters, if a leakage occurs between the electroconductive protective film and the heater wiring layer immediately after the manufacture of the substrate, the leakage can be detected in an electrical check before the assembly of the substrate. Therefore, a chip with a leakage can be excluded as a defective chip.

There is a possibility, however, that a leakage may occur in a substrate due to a thermal and mechanical impact etc. during assembly into a discharge head even if the substrate has no leakage immediately after the manufacture of the substrate. Further, even if no leakage occurs after the assembly into the discharge head, a leakage may occur due to a thermal impact, cavitation, etc. during usage of the discharge head for recording, etc. In a configuration in which the electroconductive protective film is used in common to the plural heaters, if a leakage occurs in at least one of the plural heaters, an electrochemical reaction may proceed in the electroconductive protective film on electrically connected other heaters. As a result, a change in discharge characteristics and defective discharge may be caused in nozzles corresponding to these heaters.

SUMMARY OF THE INVENTION

Embodiments of the present invention provide a liquid discharge head and a liquid discharge apparatus capable of limiting an influence of a leakage, even if a leakage occurs between a heater and an electroconductive protective film after the liquid discharge head is used for recording, etc., and preventing the entire liquid discharge head from becoming defective.

In an aspect of the present invention, a liquid discharge head which discharges a liquid, which includes a substrate on which plural heaters configured to generate heat for discharging a liquid are provided, an electroconductive protective film configured to cover the plural heaters and define a group consisting of the covered plural heaters in the substrate, a discrete wiring connected with the protective film for each group in the substrate, a common wiring connected with the discrete wiring for each group in common, and a terminal connected with the common wiring and configured to electrically connect the common wiring with an outside of the substrate. Electrical resistance of the discrete wiring is higher than electrical resistance of the common wiring.

Further features of the present invention will become apparent from the following description of exemplary embodiments with reference to the attached drawings.

DESCRIPTION OF THE EMBODIMENTS

According to an embodiments of the present invention, even if an electrochemical reaction accompanying an electrical leakage to an electroconductive protective film proceeds, an influence thereof is limited only to the electroconductive protective film and a heater in a group and, therefore, nozzles affected in a change in discharge characteristics, etc. can be limited.

Hereinafter, embodiments of the present invention are described in detail with reference to the drawings.

First Embodiment

Figure 1A:
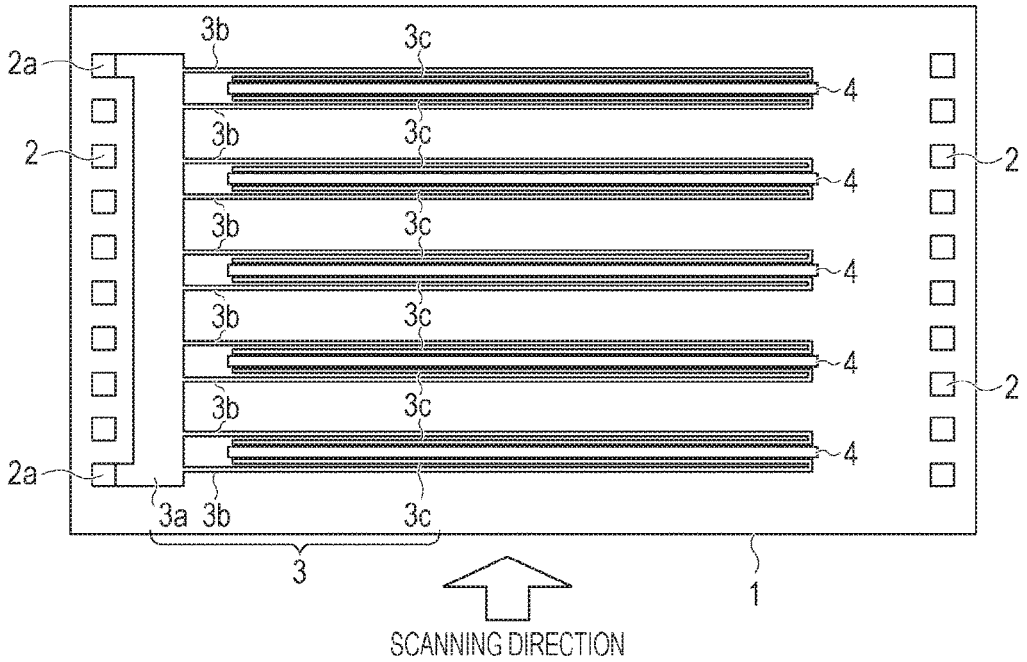
FIG. 1A is a plan view and FIG. 1B is an enlarged plan view schematically illustrating a substrate constituting an inkjet recording head according to a first embodiment of the present invention.
Figure 1B:
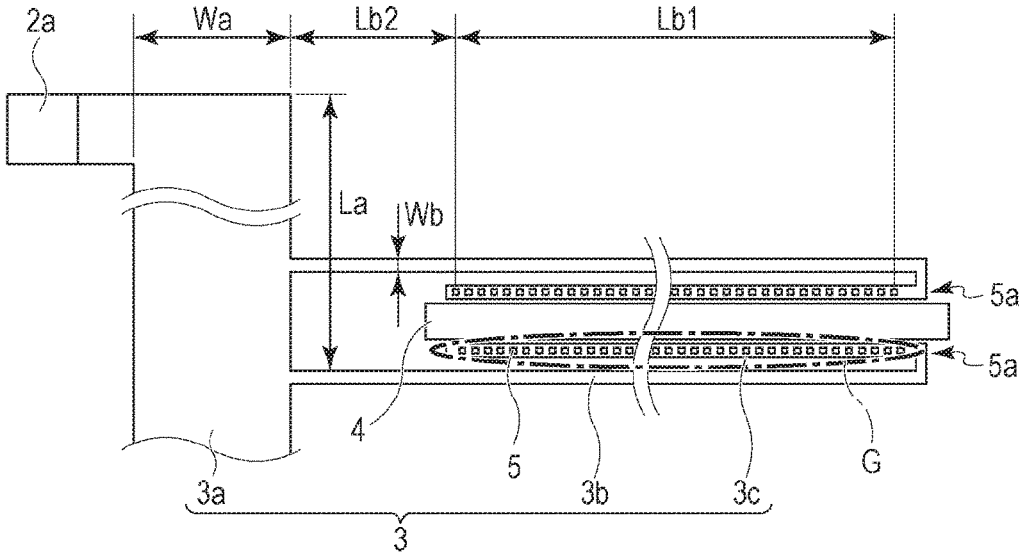

FIG. 1A is a plan view and FIG. 1B is an enlarged plan view schematically illustrating a substrate constituting an inkjet recording head according to a first embodiment of the present invention. In FIGS. 1A and 1B, a substrate 1 is provided with a pair of heater arrays in which a predetermined number of heaters 5 are arranged on both sides of an ink supply port 4. Five pairs of heater arrays 5*a* are provided each of which corresponds to each of five ink supply ports 4 provided in the substrate 1. Each of the five pairs of heater arrays 5*a* may, for example, correspond to each of different types of inks. A flow path forming member (not illustrated) in which nozzles are disposed corresponding to the heaters 5 of each heater array 5*a* is joined to the substrate 1, thereby constituting the recording head of the present embodiment. The recording head provided with the substrate 1 can record on a recording medium by scanning in a scanning direction illustrated in FIG. 1A.

Supply ports 4 in the substrate 1 are provided to penetrate the substrate 1. Therefore, ink can be supplied to pressure chambers each corresponding to each heater 5 provided on a front side of the substrate 1 from a liquid chamber on a back side via the ink supply ports 4. Plural electrode pads (terminals) are provided along sides of both ends of the substrate 1. Among these electrode pads, pads 2*a* of both ends in left pad arrays in FIG. 1A are used to check a leakage between an electroconductive protective film 3 and electrode wiring for driving the heaters described below. The electrode pads 2*a* are used also to apply a voltage so that the electroconductive protective film has a predetermined potential, and to limit an electrochemical reaction occurring between the electroconductive protective film 3 and ink upon occurrence of a leakage described later. Other electrode pads 2 are connected with electrode wiring (not illustrated) for driving the heaters 5 and, therefore, corresponding heaters 5 can be driven by driving signals supplied via the pads 2 depending on recording signals from a device control unit, and heat for discharging ink can be generated.

As illustrated in FIGS. 1A and 1B, the electroconductive protective film 3 of the present embodiment includes a relatively thick common pattern (common wiring) 3*a* which electrically connects with the pads 2*a*, and relatively thin plural wiring patterns (discrete wirings) 3*b* branching from the pattern 3*a* and electrically connecting with each of the plural heater arrays 5*a*. The electroconductive protective film 3 further includes protective patterns (protective films) 3*c*. Each branched wiring pattern 3*b* is connected with each protective pattern 3*c*. The protective pattern 3*c* protects upper surfaces of the plural heaters 5 (heater array 5*a*). The protective pattern 3*c* defines a group G of the plural heaters 5 or the heater array 5*a*. The heater array 5*a* on one side of the ink supply port 4 is considered as one group. That is, the protective patterns 3*c* define plural heater groups.

In the present embodiment, each of the plural heater arrays 5*a* constitutes the group G of the electroconductive protective film. The heater array 5*a* of each group G is connected with a common pattern 3*a* with relatively low electrical resistance (i.e., with a low sheet resistance value) via the wiring pattern 3*b* with relatively high electrical resistance (i.e., with a high sheet resistance value).

Comparison in the resistance values (sheet resistance values) in the pattern of the electroconductive protective film 3 is as follows. A width Lb1 of the heater array 5*a* is set to 0.5 inch (about 12.7 mm), and a distance Lb2 between one end of the heater array 5*a* and an end of the common pattern 3*a* is set to 500 μm. A width Wb of the pattern 3*b* is set to 10 μm. Then, a resistance value RA of the pattern 3*b* is (Lb1:12700+Lb2:500)/Wb:10=1320 sheet.

Next, a distance La of the common pattern 3*a* from the furthest end pattern 3*b* to an end portion at which the common pattern 3*a* connects with the pad 2*a* is set to 4 mm, and a width Wa is set to 500 μm. If a resistance value of a connecting portion to the pad 2*a* is ignored, a resistance value RB of the pattern 3*a* is La:4000/Wa:500=8 (sheet resistance value). Technically, the pattern 3*a* is connected with the two pads 2*a*, and the resistance value per pad corresponds to 4 sheets which are substantially half the number of 8 (sheet resistance value). A voltage of 0V is applied to these pads 2*a* by a device control unit.

In the present embodiment, with the relationship between the resistance values about the electroconductive protective film 3, even if voltage abnormality, such as a leakage, occurs in one group in the group G of the heater array, an influence on other groups can be reduced. For example, suppose that abnormality, such as a leakage, occurs in either of the heaters in one group G of the plural groups G, and a heater driving voltage VH conducts with the electroconductive protective film. Other heaters in the same group G may be affected by the voltage VH, and then an electrochemical reaction between the electroconductive protective film and the ink may proceed and a change in discharge characteristics and discharge abnormality may be caused. However, since each heater in other groups G is connected with the pad 2*a* of a potential of 0V via the pattern 3*b* with a small resistance value and the common pattern 3*a* for each group, an influence of a change in the potential of the group with abnormality is limited.

Specifically, when a leakage conducting to the driving voltage VH occurs in a heater in a certain group G, a potential of the common pattern 3*a* is applied to other groups G. This is because the wiring pattern 3*b* branched from the common pattern 3*a* is independently wired with respect to the corresponding group G. Suppose that the electroconductive protective film 3*c* on a certain heater has a VH potential due to a leakage, a maximum potential of the common pattern 3*a* can be expressed by the following Expression based on each resistance value described above:

$$VH \times RB/(RB+RA).$$

If VH is set to 24V, $$24V \times 4/(4+1320)=0.073V.$$

That is, in the above example, a voltage which affects other groups G is equal to or smaller than 0.073V, which is relatively low as a voltage.

An electrochemical reaction between the electroconductive protective film and the ink does not proceed unless the voltage exceeds a certain value. Typically, a potential at which an electrochemical reaction between a film material and an ink material proceeds is shown by a Pourbaix diagram. That is, a state in which the electrochemical reaction does not proceed can be created by setting a voltage of a dead zone in the Pourbaix diagram. This is called a cathodic protection effect.

The voltage of the common pattern of the present embodiment desirably has the voltage of the dead zone. However, even if not the voltage of the dead zone, a voltage qualitatively close to the voltage of the dead zone can retard the progress of the reaction. Therefore, a constant effect is obtained.

There is a possibility that an electrochemical reaction may proceed in other heaters in the same group as the group of the heater in which voltage abnormality, such as a leakage, is occurring. To address this problem, an image defect can be avoided or reduced by complementing the recording by a heater array (a nozzle array) of other groups for which an influence has been reduced, for example.

In the present embodiment, the pads which electrically connect the pattern of the electroconductive protective film and the device control unit are provided at two positions in the substrate. However, one pad may also provide same effect basically. Regarding a leakage test, if there are two or more pads, it is possible to perform a leakage test after confirming a connected state between these pads. By disposing these two pads with a certain space therebetween in the substrate, resistance to the outside from the common pattern can be reduced, and a voltage affecting other groups upon occurrence of a leakage can be lowered.

Second Embodiment

Figure 2A:
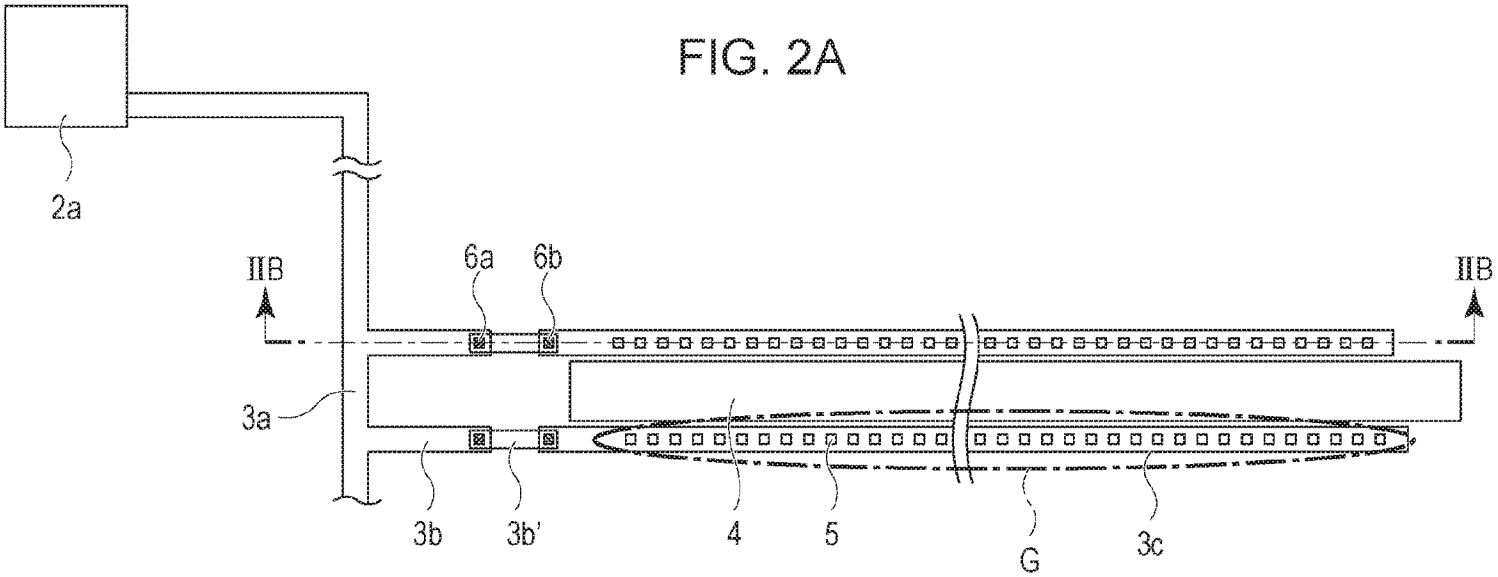
FIG. 2A is an enlarged view of a heater group on a substrate of a recording head according to a second embodiment of the present invention and FIG. 2B is a cross-sectional view along line IIB-IIB.
Figure 2B:
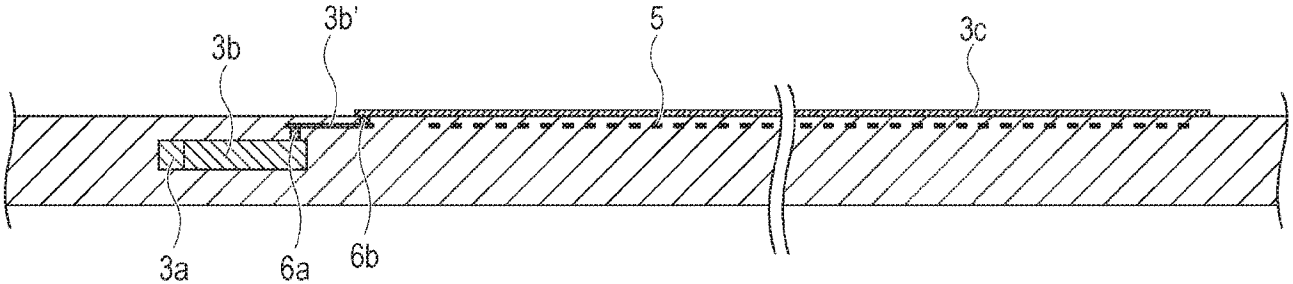

FIG. 2A is an enlarged view of a heater group G on a substrate of a recording head according to a second embodiment of the present invention and FIG. 2B is a cross-sectional view along line IIB-IIB. The present embodiment differs from the first embodiment in the following points: the patterns 3*a*, 3*b* and 3*c* are constituted by the same electroconductive protective film which is a metal film in the first embodiment, whereas a wiring pattern (discrete wiring) 3*b* and a common pattern (common wiring) 3*a* are constituted using different metal layers in the present embodiment.

As illustrated in FIGS. 2A and 2B, a protective pattern (protective film) 3*c* of an electroconductive protective film which protects upper surfaces of heaters is connected with a metal layer 3*b*' of a high resistance value constituted by a heater layer via a via 6*b*. The high resistance metal layer 3*b*' is further connected with a wiring layer (discrete wiring) 3*b* and a common wiring 3*a* with a sheet resistance value lower than that of the high resistance metal layer 3*b*' via a via 6*a*.

According to the present embodiment, a relationship of desired resistance values can be realized in a smaller substrate area or a narrower layout pattern width by using a high resistance metal layer and a wiring layer having low sheet resistance of different layers.

Third Embodiment

Figure 3A:
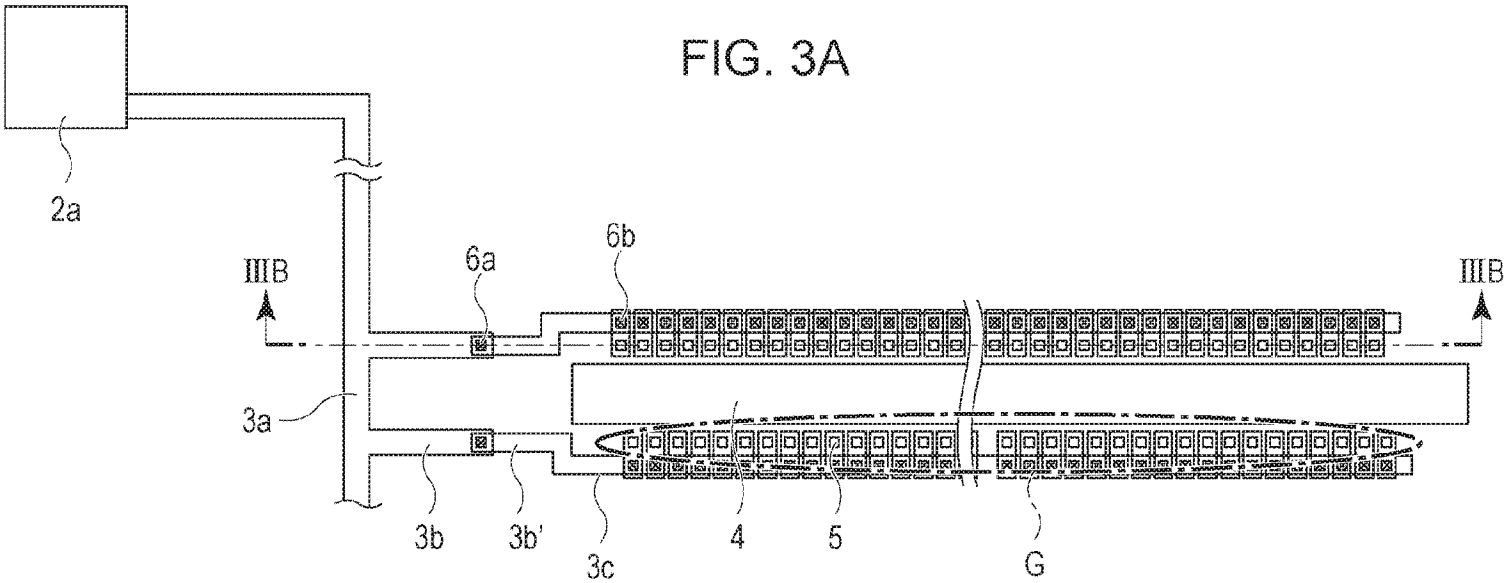
FIG. 3A is an enlarged view of a heater group on a substrate of a recording head according to a third embodiment of the present invention and FIG. 3B is a cross-sectional view along line IIIB-IIIB.
Figure 3B:
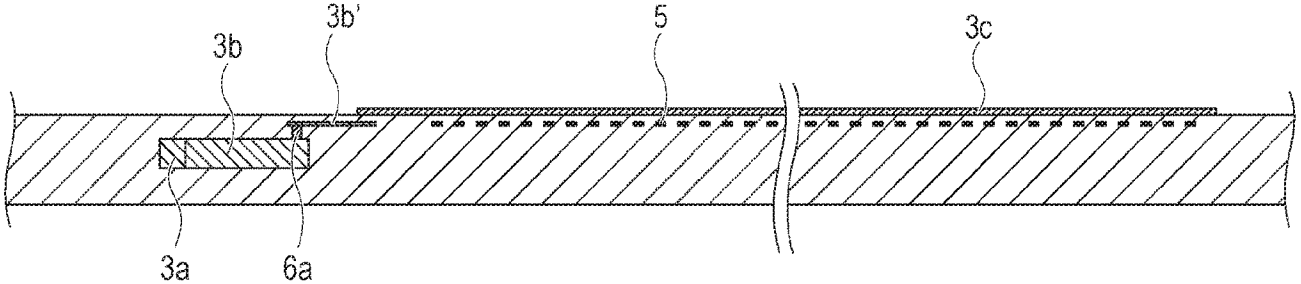

FIG. 3A is an enlarged view of a heater group G on a substrate of a recording head according to a third embodiment of the present invention and FIG. 3B is a cross-sectional view along line IIIB-IIIB. The electroconductive protective film 3*c* which protects the upper surfaces of the heaters forms continuously connected patterns in the same group G in the second embodiment, whereas an electroconductive protective film 3*c* is connected with a metal layer 3*b*' of a high resistance value via a via 6*b* provided corresponding to each heater, while forming other individual patterns of a conductive layer corresponding to each heater in the present embodiment. The metal layer 3*b*' is further connected with a wiring layer 3*b* and a common wiring 3*a* via a via 6*a*.

According to the present embodiment, further lowering of the voltage which affects other groups upon occurrence of a leakage becomes easier by setting a length of the wiring by the high resistance metal layer 3*b*' to be longer.

Fourth Embodiment

Figure 4B:
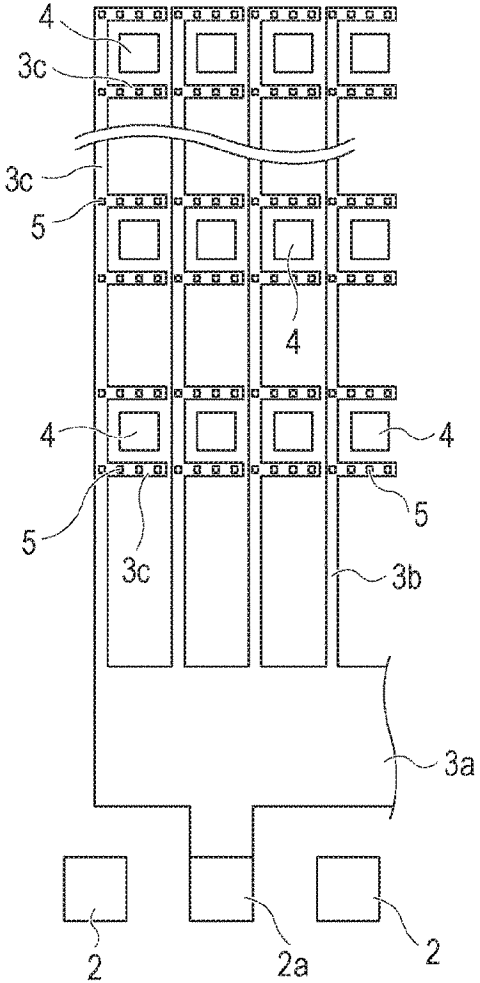
FIG. 4A is a plan view and FIG. 4B is an enlarged plan view schematically illustrating a substrate of a recording head according to a fourth embodiment of the present invention.
Figure 4A:
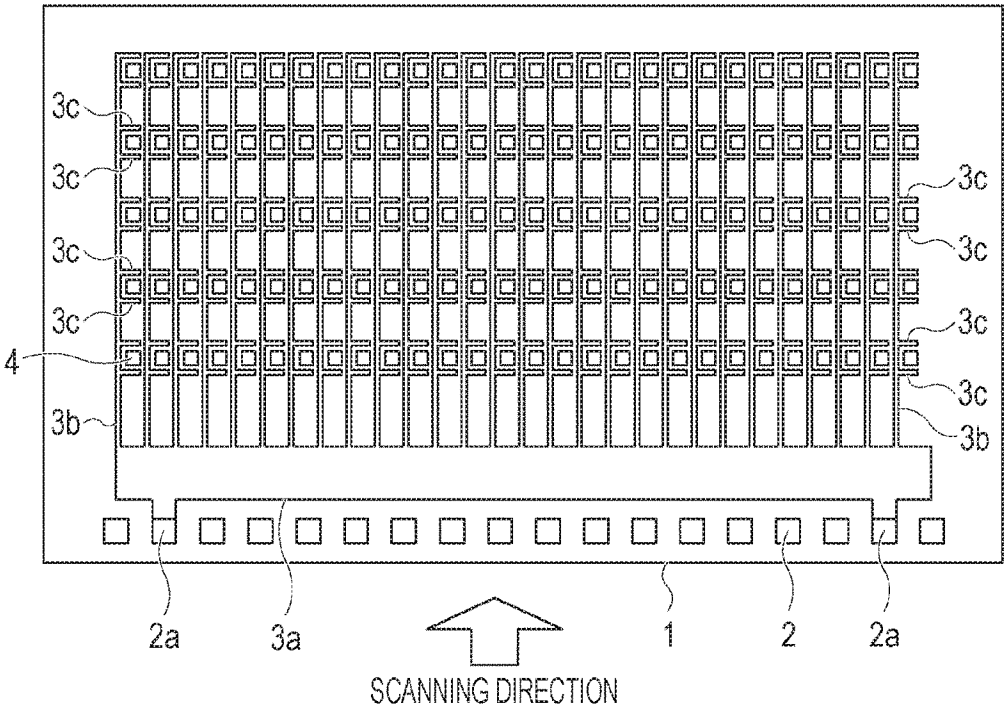

FIG. 4A is a plan view and FIG. 4B is an enlarged plan view schematically illustrating a substrate of a recording head according to a fourth embodiment of the present invention. In a substrate according to the present embodiment, plural ink supply ports 4 are arranged two-dimensionally and heaters 5 are arranged in an array on both sides of the ink supply ports 4. In the substrate 1, pads 2 and 2*a* are arranged along one side of the substrate 1 parallel to a nozzle array.

A pattern of an electroconductive protective film 3 is connected with a common pattern 3*a* of relatively thick width connected with the electrode pads 2*a* and connected with individual patterns 3*b* of relatively thin widths independently connected with the plural heater arrays. The individual patterns 3*b* are connected with the electroconductive protective film 3*c* which protects upper surfaces of the plural heaters 5.

In the present embodiment, in one protective film 3*c*, a heater group of the heaters 5 corresponding to the ink supply ports 4 arranged in a direction perpendicularly crossing an arranging direction of the nozzles corresponding to the heaters 5 (i.e., a scanning direction illustrated in FIG. 4A) is considered as one group G. That is, four heaters 5 are disposed above and below each ink supply port 4 and arranged in the direction perpendicularly crossing the scanning direction as illustrated in FIG. 4B. The group of the heaters is defined by covering, with one pattern 3*c* of the electroconductive protective film, these above and below heater arrays arranged corresponding to one ink supply port 4 in the scanning direction. Thus, in the present embodiment, the ink supply ports 4 are arranged two-dimensionally and the pattern 3*c* of the electroconductive protective film is laid between adjacent ink supply ports 4 in the substrate 1.

According to the present embodiment, if abnormality occurs in one of the heaters in the group G defined by the pattern 3*c* and a driving voltage VH of the heater conducts with the electroconductive protective film, heaters in the same group G are affected by the VH potential. As a result, an electrochemical reaction between the electroconductive protective film and the ink proceeds and a change in discharge characteristics and discharge abnormality may be caused. However, the influence of the voltage is connected with a pad 2*a* of 0V via the discrete wiring 3*b* corresponding to the group and the common wiring 3*a*, whereby the influence on other groups G are reduced.

In the first embodiment, since the group is formed on a nozzle array basis, if conduction with a VH potential occurs in at least one group, all of the nozzles (heaters) in the array in the group may be affected. On the contrary, according to the present embodiment, the range to be affected can be limited to the unit of the ink supply ports 4 of a predetermined number.

Fifth Embodiment

Figure 5:
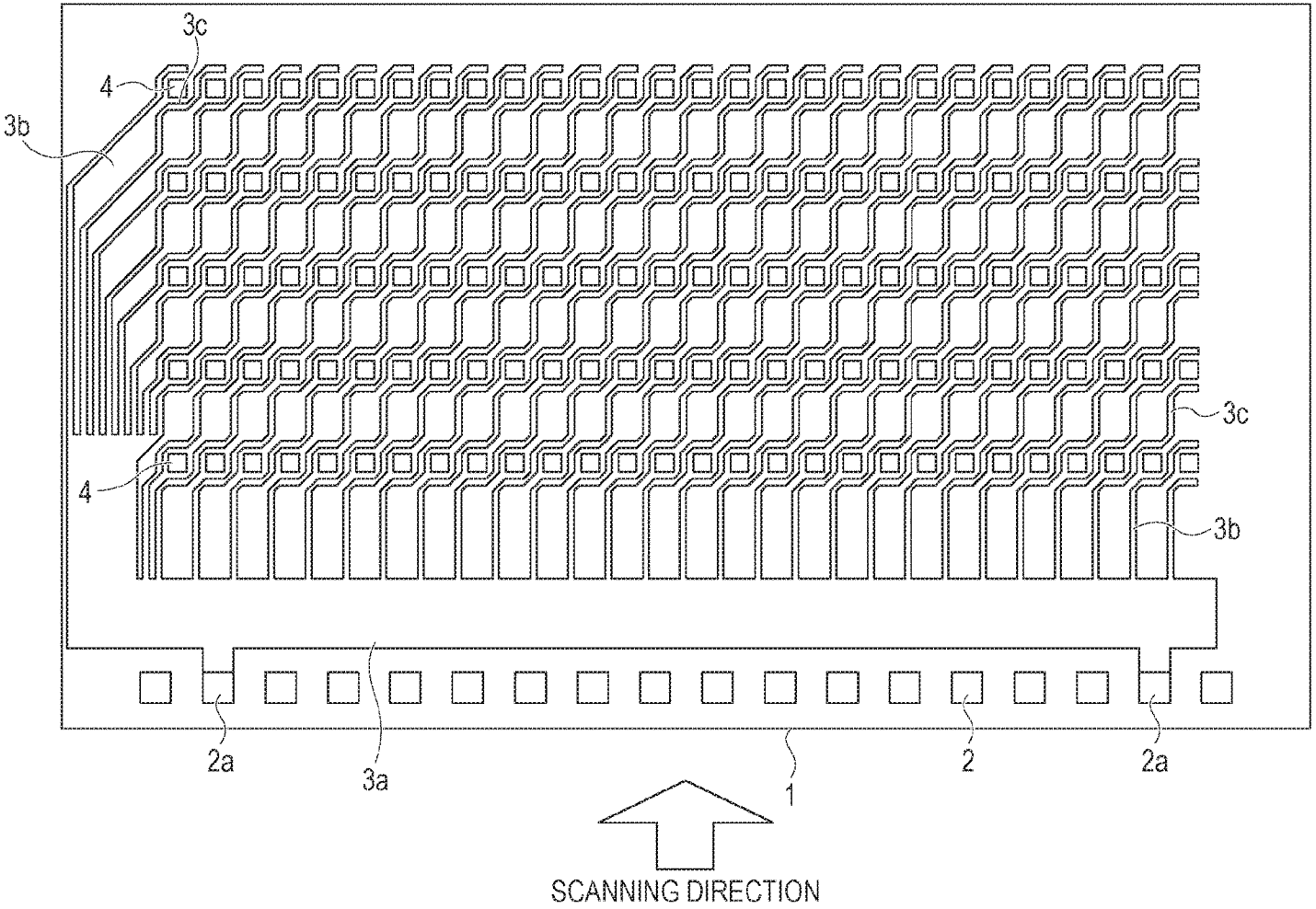
FIG. 5 is a plan view schematically illustrating a substrate of a recording head according to a fifth embodiment of the present invention.

FIG. 5 is a plan view schematically illustrating a substrate of a recording head according to a fifth embodiment of the present invention. In the fourth embodiment, groups are defined by the electroconductive protective film 3*c* in the direction perpendicularly crossing the direction of the nozzle array. In the present embodiment, groups are defined in an oblique direction. In particular, as illustrated in FIG. 5, a part of a wiring pattern 3*b* branched from a common pattern 3*a* is obliquely wired. With this configuration, with respect to the two-dimensionally arranged ink supply ports 4 and a corresponding heater group, the protective film 3*c* protects the obliquely arranged heater group (corresponding to the ink supply ports 4), and defines a group of the heater group.

According to the present embodiment, the unit of the group affected by the conduction with the VH potential can be shifted sequentially with respect to the relative moving direction (i.e., the scanning direction) to the recording medium of the recording head. Therefore, the influence of the leakage with respect to the recording area can further be reduced.

Sixth Embodiment

Figure 6:
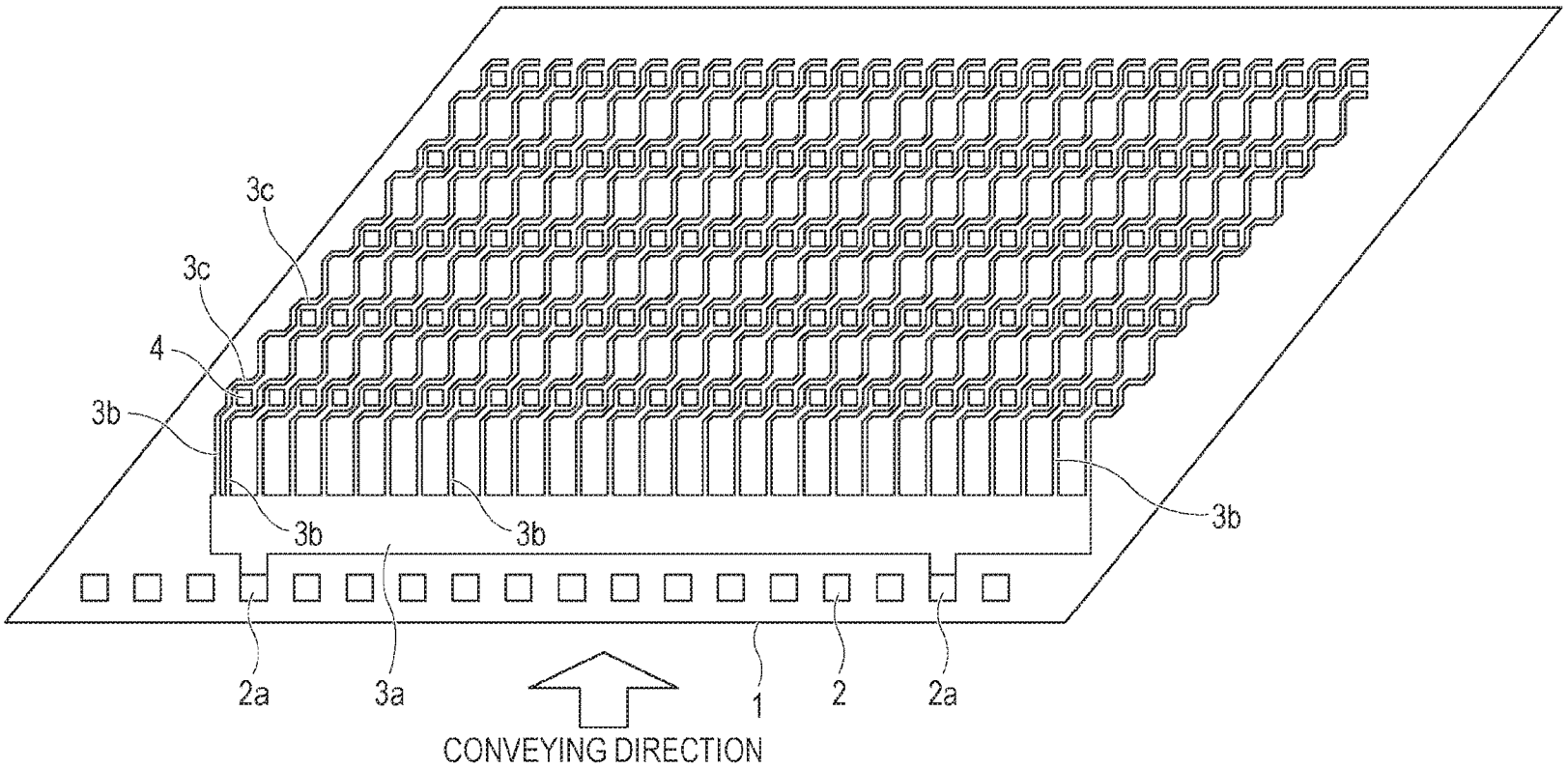
FIG. 6 is a plan view schematically illustrating a substrate of a recording head according to a sixth embodiment of the present invention.

FIG. 6 is a plan view schematically illustrating a substrate of a recording head according to a sixth embodiment of the present invention. In the present embodiment, groups defined by the electroconductive protective film 3*c* in the same manner as in the fifth embodiment are defined in an oblique direction (i.e., offset), and an outer shape of a chip (i.e., a substrate) is aligned in the oblique direction. That is, in an outer shape of the substrate 1, two facing sides do not cross perpendicularly. Therefore, the same separation pattern of the electroconductive protective film can be implemented in all the group units. That is, separation resistance is unequal partially in the electroconductive protective film 3*c* in the fifth embodiment, whereas separation resistance becomes equal in the entire region of the substrate in the present embodiment.

Figure 7:
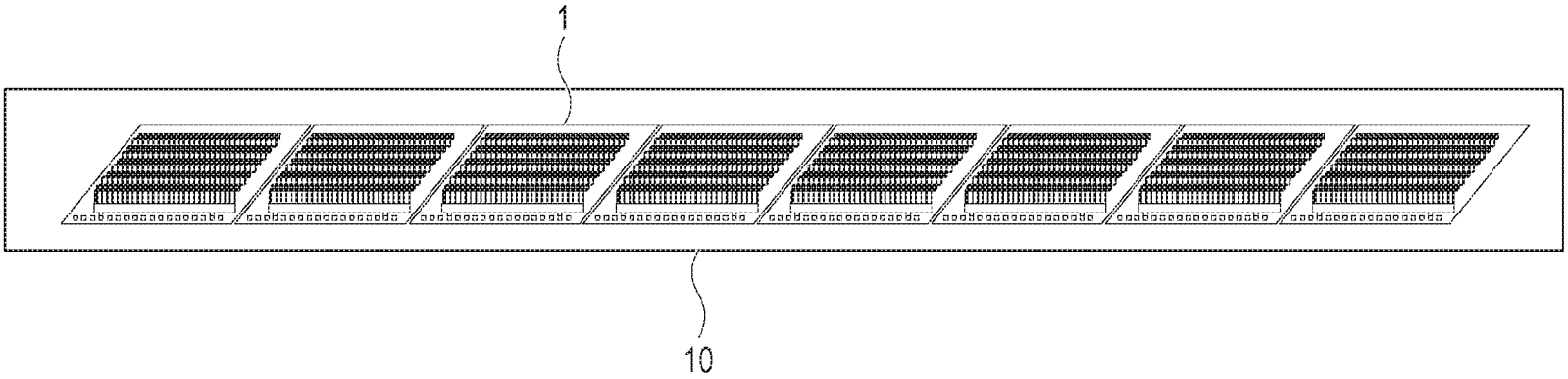
FIG. 7 is a plan view illustrating the recording head using the substrate according to the sixth embodiment.

FIG. 7 is a plan view schematically illustrating the recording head of the present embodiment in which plural substrates according to the present embodiment are arranged. As illustrated in FIG. 7, parallelogrammatic chips (substrates) are arranged substantially linearly. By conveying a recording medium in the conveying direction illustrated in FIG. 6 with respect to the elongated recording head 10, recording can be performed on the recording medium. An effect of limiting an influence by conduction between an electroconductive protective film and a heater potential is large in such an elongated head. That is, even if at least one of plural chips in the recording head becomes defective, a possibility that the entire recording head in which plural chips are arranged becomes defective can be lowered.

Liquid Discharge Apparatus

Figure 8:
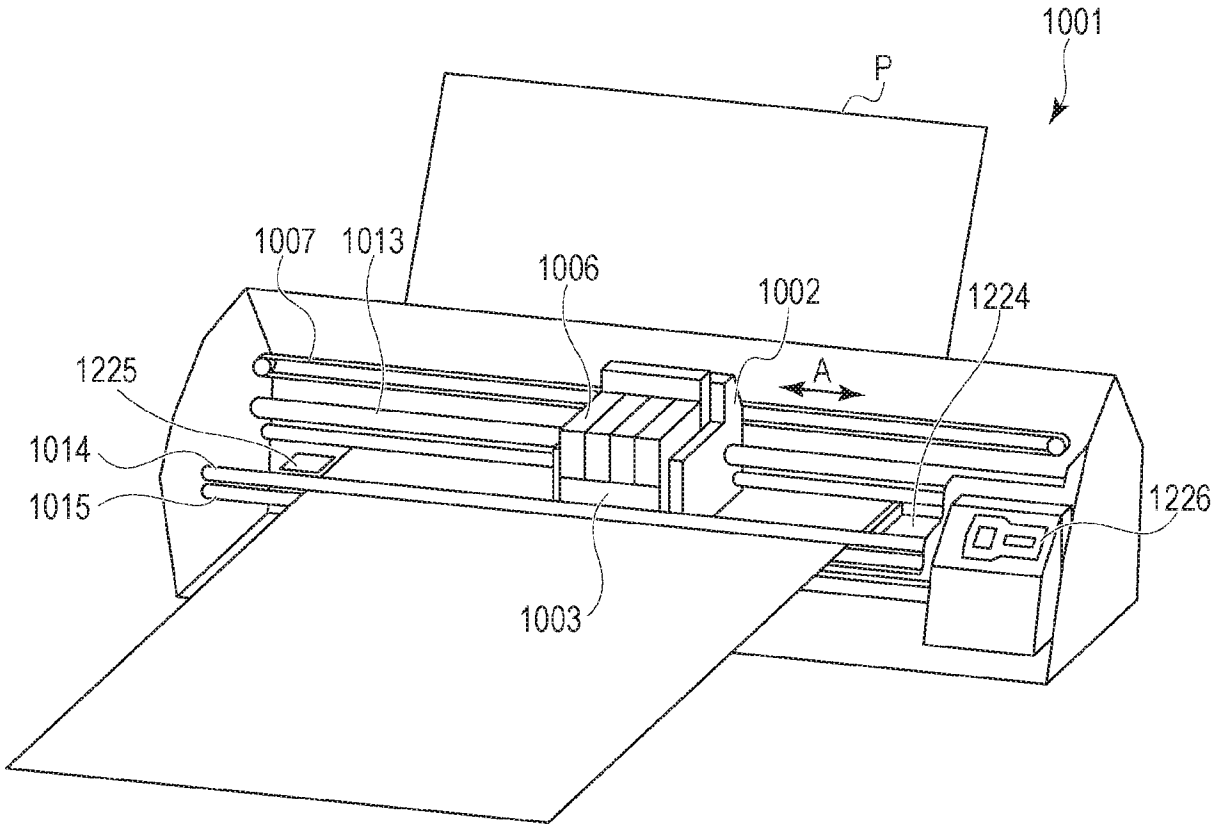
FIG. 8 is a perspective view illustrating an inkjet recording apparatus according to an embodiment of a liquid discharge apparatus of the present invention.

FIG. 8 is a perspective view illustrating an inkjet recording apparatus according to an embodiment of a liquid discharge apparatus of the present invention. In a carriage 1002 of an inkjet recording apparatus 1001, a recording head 1003 as a liquid discharge head, and an ink cartridge 1006 which stores ink to be supplied to the recording head 1003 are mounted removably. The recording head 1003 and the ink cartridge 1006 may be formed integrally with each other. The ink cartridges 1006 are prepared for the ink of magenta (M), cyan (C), yellow (Y) and black (K). These four ink cartridges 1006 are mounted on the carriage 1002.

When mounted on the carriage 1002, the recording head 1003 is electrically connected with an apparatus main body via each electrical connection portion (i.e., each pad 2 of the recording head). Therefore, the recording head 1003 can perform operations, such as discharge of ink, in response to a recording signal from the apparatus main body. The recording head 1003 can be constituted using the substrate according to the first to the fifth embodiments described above.

In the inkjet recording apparatus 1001, a guide shaft 1013 is disposed to extend along a main scanning direction of the carriage 1002. The carriage 1002 is slidably supported by the guide shaft 1013. Therefore, a motion of the carriage 1002 along the guide shaft 1013 in the direction of arrow A is guided. Driving force of a carriage motor is transmitted to the carriage 1002 via a drive belt 1007 as a transmission mechanism, whereby the carriage 1002 can reciprocate. With the above configuration, since the ink is discharged while the recording head 1003 scans in the main scanning direction, recording is performed in the entire width of a recording medium P on a platen. The recording medium P can be conveyed in the conveying direction by a conveyance roller 1014 driven by an unillustrated conveyance motor and pinch rollers 1015 which bring the recording medium P in contact with the conveyance roller 1014.

At an end portion of an moving region of the recording head 1003, a cap 1226 which caps the nozzle and can receive the ink discharged from the recording head 1003 is disposed. The ink discharged in preliminary discharge can be collected in the following manner: in a state where the nozzle of the recording head 1003 is capped, preliminary discharge with pigment ink is performed inside the cap 1226 and the ink is sucked in the cap. Outside a conveying path of the recording medium P, a platen preliminary discharge position home 1224 and a platen preliminary discharge position away 1225 at which ink can be received when the preliminary discharge is performed on the platen are disposed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-254285, filed Dec. 25, 2015, which is hereby incorporated by reference herein in its entirety.

What is claimed is:

1. A liquid discharge head which discharges a liquid, comprising:

a substrate on which plural heaters configured to generate heat for discharging a liquid are provided;

plural electroconductive protective films configured to cover the plural heaters and define groups consisting of the covered plural heaters in the substrate;

plural discrete wirings electrically connected with the plural electroconductive protective films respectively;

a common wiring electrically connected with the plural discrete wirings in common; and a terminal connected with the common wiring and configured to electrically connect the common wiring with an outside of the substrate, wherein electrical resistance of the discrete wiring is higher than electrical resistance of the common wiring.

2. The liquid discharge head according to claim 1, wherein, when electrical resistance of one of the discrete wirings is denoted by RA, electrical resistance of the common wiring is denoted by RB, and a driving voltage of the heater is denoted by VH, a value expressed by $$VH \times RB/(RB+RA)$$

is a voltage in a dead zone in which an electrochemical reaction between a liquid and the protective films does not proceed.

3. The liquid discharge head according to claim 1, wherein the protective films, the discrete wirings, and the common wiring are constituted by a common layer.

4. The liquid discharge head according to claim 1, wherein the protective film and at least a part of the discrete wiring are constituted by different layers.

5. The liquid discharge head according to claim 1, wherein the protective film, the discrete wiring, and the common wiring are constituted by different layers.

6. The liquid discharge head according to claim 1, wherein the protective films define the groups as a pattern in which common layers are connected continuously.

7. The liquid discharge head according to claim 1, wherein the protective film defines the group by electrically connecting a pattern of a predetermined layer with a different conductive layer.

8. The liquid discharge head according to claim 1, further comprising plural heater arrays each constituted by plural heaters arranged in an array, wherein the groups are formed on the heater array basis.

9. The liquid discharge head according to claim 1, further comprising plural supply ports for supplying a liquid to a pressure chamber in which the heater is provided, wherein, in a group of the groups, the protective film is provided across plural arrays of the supply ports, and the protective film is disposed between supply ports included in the same array of the supply port.

10. The liquid discharge head according to claim 9, wherein the group provided across plural arrays of the supply ports are offset with respect to relative moving directions of a medium and the liquid discharge head.

11. The liquid discharge head according to claim 10, wherein, in an outer shape of the substrate, two facing sides do not cross perpendicularly.

12. The liquid discharge head according to claim 1, wherein the plural heaters are disposed side by side.

13. The liquid discharge head according to claim 1, wherein plural terminals are connected with the common wiring.

14. The liquid discharge head according to claim 13, wherein the plural terminals are disposed with another terminal disposed therebetween.

15. A liquid discharge apparatus provided with a liquid discharge head which discharges a liquid, comprising:

a substrate on which plural heaters configured to generate heat for discharging a liquid are provided;

plural electroconductive protective films configured to cover the plural heaters and define groups consisting of the covered plural heaters in the substrate;

plural discrete wirings electrically connected with the plural electroconductive protective films respectively;

a common wiring electrically connected with the plural discrete wirings in common; and a terminal connected with the common wiring and configured to electrically connect the common wiring with an outside of the substrate, wherein electrical resistance of the discrete wiring is higher than electrical resistance of the common wiring.

16. The liquid discharge apparatus according to claim 15, wherein, when electrical resistance of one of the discrete wirings is denoted by RA, electrical resistance of the common wiring is denoted by RB, and a driving voltage of the heater is denoted by VH, a value expressed by $$VH \times RB/(RB+RA)$$

is a voltage in a dead zone in which an electrochemical reaction between a liquid and the protective films does not proceed.

* * * * *